US008404988B2

(12) United States Patent
Cheng

(10) Patent No.: US 8,404,988 B2
(45) Date of Patent: Mar. 26, 2013

(54) CONTROL ASSEMBLY

(75) Inventor: Da-Qing Cheng, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 232 days.

(21) Appl. No.: 12/881,362

(22) Filed: Sep. 14, 2010

(65) Prior Publication Data

US 2011/0303522 A1 Dec. 15, 2011

(30) Foreign Application Priority Data

Jun. 10, 2010 (CN) ..... 2010 1 0195165

(51) Int. Cl.
*H01H 13/00* (2006.01)

(52) U.S. Cl. ..... 200/345; 200/520; 200/341

(58) Field of Classification Search ..... 200/517, 200/520, 296, 329, 341–345; 400/490–496; 341/22; 345/168, 169; 455/550.1
See application file for complete search history.

(56) References Cited

U.S. PATENT DOCUMENTS

| | | | | | |
|---|---|---|---|---|---|
| 4,128,744 | A * | 12/1978 | Seeger | 200/5 A |
| 4,304,973 | A * | 12/1981 | Fenelle et al. | 200/330 |
| 4,363,942 | A * | 12/1982 | Deeg et al. | 200/5 A |
| 4,827,243 | A * | 5/1989 | Cheng | 341/22 |
| 5,760,351 | A * | 6/1998 | Tsai | 200/5 A |
| 5,952,634 | A * | 9/1999 | Yoshida | 200/302.2 |
| 6,300,582 | B1 * | 10/2001 | Huang | 200/302.2 |
| 7,875,819 | B2 * | 1/2011 | Izumi | 200/293 |
| 2007/0084702 | A1 * | 4/2007 | Lin et al. | 200/5 A |
| 2007/0119693 | A1 * | 5/2007 | Kwong et al. | 200/5 A |

* cited by examiner

*Primary Examiner* — Michael Friedhofer
(74) *Attorney, Agent, or Firm* — Altis Law Group, Inc.

(57) ABSTRACT

A control assembly is assembled between a housing and a printed circuit board of an electronic device. The housing defines a mounting hole. The control assembly includes a force member assembled in the mounting hole, a switch electrically fixed on the printed circuit board under the force member, and a resilient member abutted between the force member and the printed circuit board. The resilient member is compressed to allow the force member to contact the switch when external force applied to the force member.

9 Claims, 3 Drawing Sheets

CONTROL ASSEMBLY

BACKGROUND

1. Technical Field

The disclosure relates, generally, to a device control, and particularly, to a control assembly of electronic devices.

2. Description of Related Art

Many electronic devices include a housing with an interior compartment receiving a printed circuit board (PCB) therein. The electronic device often includes a control assembly for directing various operations. In use, however, the controls of the electronic device are prone to accidental activation. Thus, accuracy and reliability of such controls is less than dependable.

Therefore, there is room for improvement within the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout several views, and all the views are schematic.

DETAILED DESCRIPTION

Figure 1:
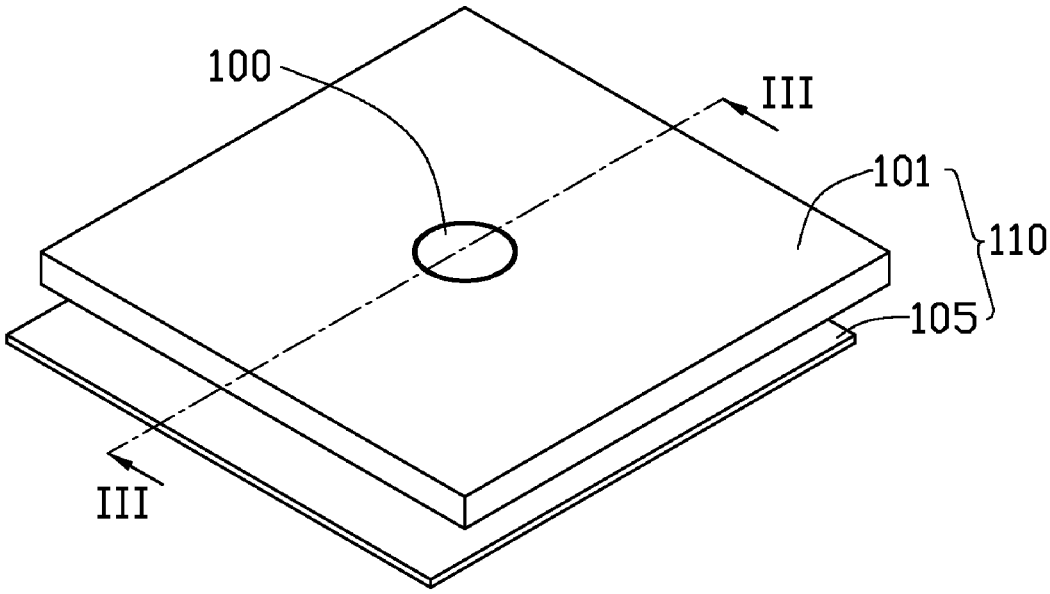
FIG. 1 is an assembled, isometric view of an embodiment of a control assembly assembled between a base and a housing of an electronic device.

Referring to FIG. 1, a control assembly 100 is utilized in an electronic device 110, such as a personal digital assistant (PDA), mobile phone, MP3 player, or MP4 player. The electronic device 110 includes a housing 101 and a printed circuit board 105. The control assembly 100 is fixed between the housing 101 and the printed circuit board. The electronic device 110 includes various modules for performing specific function and features. However, for simplicity, only the module related to the control assembly 100 is described.

Figure 2:
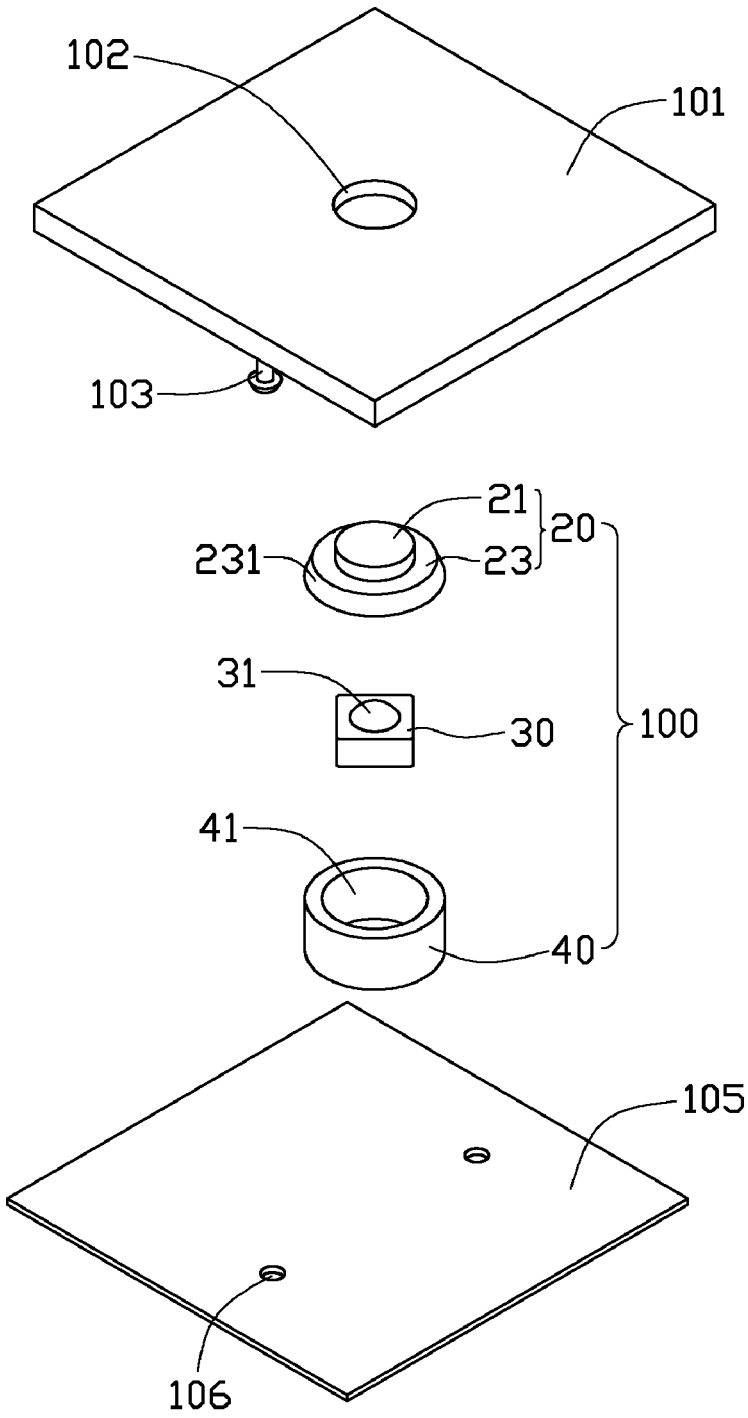
FIG. 2 is an exploded, isometric view of the control assembly with the base and housing of FIG. 1.

Referring to FIG. 2, the housing 101 defines a mounting hole 102. In the illustrated embodiment, the mounting hole 102 is a stepped through hole including a conical frustum portion 104 defined in an inner side of the housing 101 and a cylindrical portion 107 communicating with the conical frustum portion 104. An inner diameter of the conical frustum hole portion 104 progressively increases away from the cylindrical portion 107. The housing 101 forms a pair of fixing members 103. The fixing members 103 can be bolts, rivets, or solder. In the illustrated embodiment, the fixing members 103 are solder. The printed circuit board 105 defines a pair of fixing holes 106 corresponding to the fixing members 103. In the illustrated embodiment, the pair of fixing members 103 fixedly passes through the corresponding fixing holes 106. Thus, the control assembly 100 can be positioned between the housing 101 and the printed circuit board 105 tightly.

Referring to FIG. 2, the control assembly 100 includes a force member 20, a switch 30, and a resilient member 40. The force member 20 is located in the mounting hole 102. The switch 30 is electrically fixed on the printed circuit board 105. The resilient member 40 is abutted between the force member 20 and the printed circuit board 105. When an external force is applied to the force member 20, the resilient member 40 can be compressed to allow the force member 20 to contact the switch 30. When the external force is removed, an elastic force created by the resilient member 40 returns the force member 20 to an original position.

Figure 3:
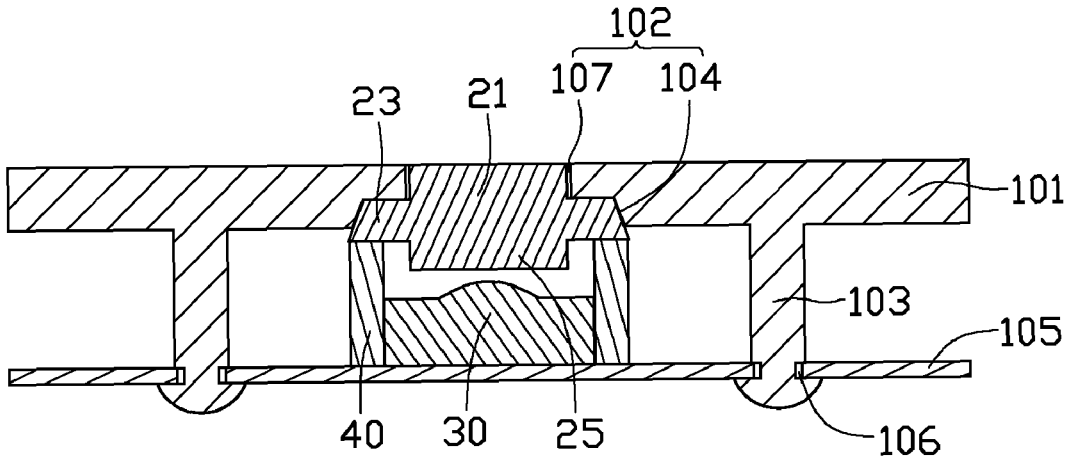
FIG. 3 is a cross-section of the control assembly of FIG. 1, taken along line III-III.

Referring to FIGS. 2 and 3, the force member 20 includes a moving portion 21, a guide portion 23, and a contact portion 25. The moving portion 21 and the contact portion 25 respectively extend from two opposite ends of the guide portion 23. In other words, the guide portion 23 interconnects the moving portion 21 and the contact portion 25. The guide portion 23 can be a cylinder, a conical frustum, a rectangular prism, a cube, or other shape. In the illustrated embodiment, the shape of the guide portion 23 is a conical frustum. The guide portion 23 is received in the conical frustum portion 104 of the mounting hole 102 and the moving portion 21 is received in the cylindrical portion 107 of the mounting hole 102. The guide portion 23 defines a side surface 231 which is angled with an axis of the guide portion 23. The side surface 231 is a conical surface matching an inner surface of the conical frustum portion 104 of the mounting hole 102 of the housing 101. When the external force is applied, the force member 20 moves parallel to the axis of the guide portion 23, because the side surface 231 matches the inner surface of the conical frustum portion 104.

The switch 30 is a block. The switch 30 further defines a contact protrusion 31 on a top surface of the switch 30. The contact portion 25 extends from an end surface of the guide portion 23 away from the moving portion 21 corresponding to the contact protrusion 31. When the external force is applied to force member 20, the resilient member 40 is compressed until the contact portion 25 reaches the contact protrusion 31 of the switch 30, which opens accordingly.

The resilient member 40 can be a spring, a foam ring, rubber ring, or any elastic element. In the illustrated embodiment, the resilient member 40 is a foam ring.

During assembly, the switch 30 is first electrically fixed on the printed circuit board 105. The resilient member 40 is then placed on the printed circuit board 105 and surrounds the corresponding switch 30. Next, the force member 20 is received in the mounting hole 102. Finally, the fixing members 103 fixedly pass through the corresponding fixing holes 106 to fix the control assembly 100 between the housing 101 and the printed circuit board 105. At the same time, the resilient member 40 abuts the contact portion 25. Due to the resilient member 40 abutting the contact portion 25, the control assembly 100 prevents accidental activation.

In use, the force member 20 of the control assembly 100 cannot relocate along a horizontal axis of the housing 101 due to the guide portion 23, such that the force member 20 cannot be locked into the housing 101. In addition, because the side surface 231 of the guide portion 23 is angled with an axis of the guide portion 23, and matches an inner surface of the conical frustum portion 104 of the mounting hole 102, the housing 101 of the electronic device is sealed to external contaminants. Furthermore, because the guide portion 23 is a conical frustum and an outer diameter of the guide portion progressively increases toward the switch 30, friction during the slide of the force member 20 is decreased, and the control assembly 100 is more sensitive.

In an alternative embodiment, the side surface 231 of the guide portion 23 may be parallel to a moving direction of the force member. At this time, the cylindrical portion 107 can be replaced to a conical frustum portion, and the moving portion 21 can be changed to match the conical frustum portion.

Finally, while various embodiments have been described and illustrated, the disclosure is not to be construed as being limited thereto. Various modifications can be made to the embodiments by those skilled in the art without departing from the true spirit and scope of the disclosure as defined by the appended claims.

What is claimed is:

1. A control assembly positioned between a housing and a printed circuit board of an electronic device, the housing defining a mounting hole, the control assembly comprising:

a force member assembled in the mounting hole;

a switch electrically fixed on the printed circuit board under the force member; and a resilient member being positioned between the force member and the printed circuit board, wherein the switch is positioned in an inner space of the resilient member and is surrounded by the resilient member, and the resilient member is compressed and the force member contacts the switch when external force is applied.

2. The control assembly of claim 1, wherein the force member comprises a moving portion, a contact portion, and a guide portion interconnecting the moving portion and the contact portion.

3. The control assembly of claim 2, wherein the mounting hole is a stepped through hole comprising a conical frustum portion defined in an inner side of the housing and a cylindrical portion communicating with the conical frustum portion, and an inner diameter of the conical frustum portion progressively increases towards the switch.

4. The control assembly of claim 3, wherein the guide portion defines a side surface angled with an axis of the guide portion.

5. The control assembly of claim 4, wherein the side surface is a conical surface matching an inner surface of the conical frustum portion of the mounting hole of the housing.

6. The control assembly of claim 1, wherein the resilient member is seated on the printed circuit board.

7. The control assembly of claim 6, wherein the resilient member is a spring, a foam ring, or a rubber ring.

8. The control assembly of claim 1, wherein the housing forms at least a pair of fixing members, and the printed circuit board defines at least a pair of fixing holes corresponding to the fixing members, wherein the fixing members fixedly pass through the corresponding fixing holes.

9. The control assembly of claim 8, wherein the fixing members are bolts, rivets, or solder.

* * * * *